US007374855B2

(12) United States Patent
Wayman et al.

(10) Patent No.: US 7,374,855 B2
(45) Date of Patent: May 20, 2008

(54) PHOTORECEPTORS

(75) Inventors: William H. Wayman, Ontario, NY (US); Douglas A. Lundy, Webster, NY (US); John S. Facci, Webster, NY (US); Moritz Wagner, Walworth, NY (US); Michael J. Turan, Walworth, NY (US); Charles D. Deichmiller, Walworth, NY (US)

(73) Assignee: Xerox Corporation, Stamford, CT (US)

( * ) Notice: Subject to any disclaimer, the term of this patent is extended or adjusted under 35 U.S.C. 154(b) by 431 days.

(21) Appl. No.: 11/125,485

(22) Filed: May 10, 2005

(65) Prior Publication Data

US 2006/0257771 A1 Nov. 16, 2006

(51) Int. Cl.
*G03G 5/00* (2006.01)

(52) U.S. Cl. ..... 430/127; 430/56; 430/58.65; 430/59.1; 430/59.4

(58) Field of Classification Search ..... 430/127, 430/56, 58.65, 59.7, 59.4
See application file for complete search history.

(56) References Cited

U.S. PATENT DOCUMENTS 3,992,091 A 11/1976 Fisher
4,076,564 A 2/1978 Fisher
4,265,990 A 5/1981 Stolka et al.
4,286,033 A 8/1981 Neyhart et al.
4,291,110 A 9/1981 Lee
4,298,697 A 11/1981 Baczek et al.
4,338,387 A 7/1982 Hewitt
4,338,390 A 7/1982 Lu
4,346,158 A 8/1982 Pai et al.
4,560,635 A 12/1985 Hoffend et al.
4,654,284 A 3/1987 Yu et al.
4,764,448 A * 8/1988 Yoshitomi et al. ..... 430/119.81
4,870,465 A 9/1989 Lindblad et al.
5,162,183 A 11/1992 Lindblad et al.
5,187,039 A 2/1993 Meyer
5,302,485 A * 4/1994 Swain ..... 430/127
5,381,211 A 1/1995 Godlove
5,919,594 A * 7/1999 Perry et al. ..... 430/127
6,156,468 A 12/2000 Wehelie et al.
6,177,219 B1 1/2001 Yuh et al.
6,255,027 B1 7/2001 Wehelie et al.
6,416,389 B1 7/2002 Perry et al.
6,790,573 B2 9/2004 Drappel et al.
6,800,411 B2 10/2004 Tong et al.
6,818,366 B2 11/2004 Qi et al.
6,824,940 B2 11/2004 Wu et al.
2004/0115548 A1 6/2004 Tong et al.

* cited by examiner

*Primary Examiner*—Mark A Chapman
(74) *Attorney, Agent, or Firm*—Carter, DeLuca, Farrell & Schmidt, LLP

(57) ABSTRACT

Methods for texturing the surface of photoreceptors are provided.

21 Claims, 5 Drawing Sheets

PHOTORECEPTORS

BACKGROUND

This disclosure relates to imaging members and, more specifically, to imaging members having a modified surface layer possessing excellent resistance to wear and reduced formation of laterally conductive deposits that could lead to lateral charge migration print defects.

Imaging members, i.e., photoreceptors, can take several forms including flexible belts, rigid drums, plates, and the like. Electrophotographic photoreceptors can be prepared with either a single layer configuration or a multilayer configuration. Multilayered photoreceptors may include a substrate support, an electrically conductive layer, an optional charge blocking or hole blocking layer, an optional adhesive layer, a charge generating layer, a charge transport layer, an optional protective or overcoating layer and, in some belt embodiments, an anticurl backing layer. In the multilayer configuration, the active layers of the photoreceptor are the charge generation layer (CGL) and the charge transport layer (CTL).

Lateral charge migration (LCM) is one problem which can result from the repetitive cyclic use of photoreceptors. LCM on photoreceptor surfaces results in line and halftone dot growth and a general streaky print appearance. LCM is caused by a thin conductive film which forms on the photoreceptor surface after repeated use. Photoreceptor filming by developer material components initiated by cleaner brush fiber strikes is one factor contributing to the formation of a laterally conductive film. The latter filming is a collection point for conductive species generated by the charging devices. Conductive species are formed when volatile organic contaminants (VOC) in the air combine with ozone/nitrogen oxide/nitric acid emissions from corona charging devices utilized in xerographic print engines. The combination of VOC and ozone/nitrogen oxide/nitric acid emissions and photoreceptor filming can lead to the formation of the laterally conductive films on the photoreceptor surface that lead to LCM print defects.

As the longevity requirements of photoreceptors increases, the development of LCM defects become a problem, especially where the photoreceptor is placed in an environment having VOC contamination, even in those cases where the contamination is only in the parts per billion (ppb) range. The life of a photoreceptor in these environments may only be about 30,000 pages (30 kP), and the only known solution to overcome the LCM defect is to replace the photoreceptor.

Photoreceptors having low sensitivity with respect to laterally conductive film deposits are thus desirable.

SUMMARY

The present disclosure provides a method for producing a textured photoreceptor by subjecting an external surface of a photoreceptor to an abrasive component to enable a textured photoreceptor.

Methods for reducing lateral charge migration defects for a photoreceptor are also provided by subjecting an external surface of a photoreceptor to an abrasive component to enable a textured photoreceptor.

The present disclosure also provides photoreceptors having a charge generation layer and a charge transport layer, wherein a surface of the charge generation layer is textured. In embodiments the textured surface is generated by subjecting said surface to an abrasive component, and the textured surface optionally possesses a mean surface roughness of from about 0.1 micrometers to about 1 micrometers.

The present disclosure also provides methods for providing texture to a surface of a photoreceptor by blasting the external surface of a photoreceptor with an abrasive component at a pressure of from about 5 psi to about 150 psi for an optional period of time of from about 0.1 seconds to about 10 minutes.

BRIEF DESCRIPTION OF THE DRAWINGS

Various embodiments of the present disclosure will be described herein below with reference to the figures wherein.

DETAILED DESCRIPTION OF THE PREFERRED EMBODIMENTS

Figure 1:
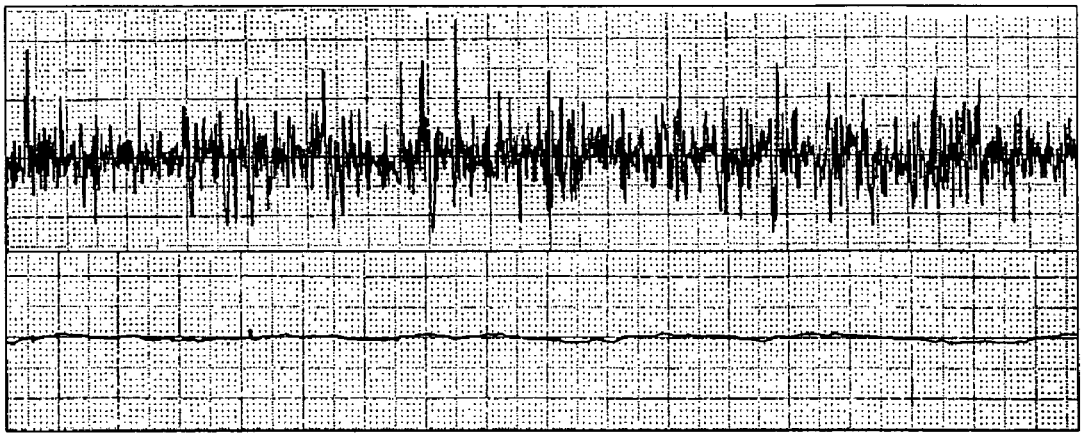
FIG. 1 is a surface profilometry scan of a textured photoreceptor surface of the present disclosure demonstrating the roughness of the surface.

The present disclosure provides methods for generating a textured photoreceptor. The textured photoreceptor reduces volatile organic contaminant (VOC) induced lateral charge migration defects in prints produced with the photoreceptor.

In embodiments of the present disclosure, the surface of a photoreceptor may be textured by blasting. Apparatus which may be utilized for blasting include pressure or siphon fed sand blasters. At its simplest, an apparatus utilized for blasting should include a gun or nozzle for directing the media utilized in blasting at the surface of the photoreceptor and a transport system for transferring the media from a holding tank or storage vessel to the nozzle or gun.

Blasting can be carried out by directing a pressurized air stream containing abrasive component particles at or across the surface of the photoreceptor. Blasting may take place under wet or dry conditions. Abrasive components which may be utilized as the blasting media include, but are not limited to, bicarbonate salts including sodium bicarbonate, carbonate salts including sodium carbonate, water, ice, dry ice, $CO_2$ pellets, glass particles, steel particles, polymeric media including polyester, urea-formaldehyde, melamine-formaldehyde, phenol-formaldehyde, acrylic, starch-acrylic, mineral media including kieserite, garnet, aluminum oxide, silicon carbide, silicon oxide, pumice, natural media including ground walnut, walnut shell flour, ground peanut shells, wheat starch, corn cob, rice hulls and combinations thereof.

The size of the particles utilized as the abrasive component may vary from about 0.5 micrometers in diameter to about 1000 micrometers in diameter, in embodiments from about 40 micrometers in diameter to about 300 micrometers in diameter, in embodiments from about 75 micrometers in diameter to about 150 micrometers in diameter.

The abrasive component particles may be directed at the photoreceptor surface at a delivery pressure that is usually less than about 175 psi. The pressure may be from about 5 psi to about 150 psi, in embodiments from about 50 psi to about 125 psi, in embodiments from about 75 psi to about 100 psi.

Where carbon dioxide is utilized to provide texture to a surface, the carbon dioxide may be in the form of particles having irregular shape. Such carbon dioxide particles or granules may be formed by grinding solid blocks of carbon dioxide (dry ice) or by phase transformation followed by fracturing. Pellets or shaved dry ice sources may also be used. The grinding process involves shaving solid blocks of carbon dioxide (dry ice) to form irregularly shaped particles. The irregularly shaped carbon dioxide particles are fractured solid particles having random angular surface features comprising corners, sharp edges and the like, and therefore are unlike cylindrically shaped carbon dioxide pellets, carbon dioxide snowflakes, or carbon dioxide spheres. The carbon dioxide particles or granules have an average particle size from about 50 micrometers to about 1000 micrometers, in embodiments from about 200 micrometers to about 300 micrometers. In embodiments, liquid carbon dioxide may be fed into a pelletizer. Pelletizers are commercially available machines and include, for example, Model P750 available from Cold Jet, Inc. (Loveland, Ohio). The pelletizer converts the liquid phase into the solid phase by extrusion, forming cylindrically-shaped carbon dioxide pellets. In embodiments, extruded pellets may have a nominal diameter of about 0.045 inch (1.14 millimeters) and lengths from about ⅛ inch (3.18 millimeters) to about ⅜ inch (9.53 millimeters). As the pellets are transported to the gun component utilized in blasting the surface of a photoreceptor, they collide with each other and the transport system conduit walls, thus randomly breaking them up into irregularly-shaped granules. The pelletizing (or extrusion) $CO_2$ pellet forming process implements different sized die so that the pellet size can be dialed in to the appropriate value. Since collisions occur during transport, pellets are extruded larger than the granules exiting from the gun.

It may be desirable to have a carbon dioxide granule size at gun exit from about 0.5 micrometers to about 1000 micrometers, in embodiments from about 50 micrometers to about 200 micrometers.

Regardless of the abrasive component utilized as the blasting media, the blasting may be carried out for a time period sufficient to provide texture to the photoreceptor surface, which can be from about 0.1 seconds to about 10 minutes, in embodiments from about 30 seconds to about 3 minutes. The duration of blasting will depend on various factors, such as the surface area being blasted; the thickness and specific composition of the photoreceptor surface; the size and type of abrasion media utilized to texture the photoreceptor; and the like.

The nozzle of the gun component utilized to direct the blasting media at the surface of the photoreceptor may be at a distance of about 0.1 inches to about 12 inches from the surface of the photoreceptor, in embodiments from about 1 inch to about 3 inches from the surface of the photoreceptor.

Other techniques for providing texture to the surface of the photoreceptor may be used in combination with the blasting techniques described above. For example, the surface can be manually or automatically scrubbed with a fiber pad, e.g., a pad with polymeric, metallic or ceramic fibers, before or after blasting, or in place of blasting. Alternatively, the surface can be textured with a flexible wheel or belt in which alumina or silicon carbide particles have been embedded before or after blasting. Liquid abrasive materials may also be used on the wheels or belts.

Hot stamping (gravure roll) may also be utilized during the photoreceptor manufacturing process in combination with the blasting process described above to produce a textured surface on a photoreceptor of the present disclosure.

The resulting photoreceptor will have a surface roughness that inhibits the formation of lateral charge migration defects. Surface roughness can be characterized by: $R_a$ (mean roughness) and $R_{max}$ (maximum roughness depth). $R_a$ is the arithmetic average of all departures of the roughness profile from the center line within the evaluation length. $R_a$ is defined by a formula:

$$R_a = \frac{1}{l_m}\int_0^{l_m} |y|\, dx$$

in which $l_m$ represents the evaluation length, and $|y|$ represents the absolute value of departures of the roughness profile from the center line.

The expression $R_{max}$ represents the largest single roughness gap within the evaluation length. The evaluation length is that part of the traversing length that is evaluated. An evaluation length containing five consecutive sampling lengths is taken as a standard. Measurements of the various surface roughness parameters described herein may be made with commercially available apparatus, including a TSK Surfcom 570A Surface Texture Measurement System (from Tokyo Seimitsu Co. Ltd., Japan).

The surface profile of the textured photoreceptor produced by the methods of the present disclosure may have a roughness value, $R_a$, from about 0.1 micrometers to about 1.0 micrometers, in embodiments from about 0.15 micrometers to about 0.5 micrometers. The specific degree of roughness will depend on various factors, such as the blasting media blasting techniques, and end use applications.

The above methods may be used to treat the surface of any configuration for photoreceptors within the purview of those skilled in the art. Such configurations include, for example, single layer photoreceptors and multi-layer photoreceptors. The photoreceptor may have any suitable shape including, for example, a plate, seamless belt, hollow or solid cylinder, and the like. Suitable configurations of multi-layer photoreceptors include, but are not limited to, the photoreceptors described in U.S. Pat. Nos. 6,800,411, 6,824,940, 6,818,366, 6,790,573, and U.S. Patent Application Publication No. 20040115546, the entire contents of each of which are incorporated by reference herein. Multi-layer photoreceptors in embodiments possess a charge generating layer (CGL), also referred to herein as a photogenerating layer, and a charge transport layer (CTL). Other layers, including a substrate, an electrically conductive layer, a charge blocking or hole blocking layer, an adhesive layer, and/or an overcoat layer, may also be present in the photoreceptor.

Suitable substrates which may be utilized in forming a photoreceptor may be opaque or substantially transparent, and may include any suitable organic or inorganic material having the requisite mechanical properties. The substrate may be flexible, seamless, or rigid and may be of a number of different configurations such as, for example, a plate, a cylindrical drum, a scroll, an endless flexible belt, and the like. In embodiments, it may be desirable to coat on the back of the substrate, particularly when the substrate is a flexible organic polymeric material, an anticurl layer such as, for example, polycarbonate materials commercially available as MAKROLON® from Bayer Material Science.

The thickness of the substrate layer may depend on numerous factors, including mechanical performance and economic considerations. For rigid substrates, the thickness of the substrate can be from about 3 millimeters to about 10 millimeters, in embodiments from about 4 millimeters to about 8 millimeters. For flexible substrates, the substrate thickness can be from about 65 micrometers to about 150 micrometers, in embodiments from about 75 micrometers to about 100 micrometers, for optimum flexibility and minimum stretch when cycled around small diameter rollers of, for example, 19-millimeter diameter. The entire substrate can be made of an electrically conductive material, or the electrically conductive material can be a coating on a polymeric substrate.

Substrate layers selected for the imaging members of the present disclosure, and which substrates can be opaque or substantially transparent, may include a layer of insulating material including inorganic or organic polymeric materials such as MYLAR® (a commercially available polymer from DuPont), MYLAR® containing titanium, a layer of an organic or inorganic material having a semiconductive surface layer, such as indium tin oxide or aluminum arranged thereon, or a conductive material inclusive of aluminum, chromium, nickel, brass or the like.

Any suitable electrically conductive material can be employed with the substrate. Suitable electrically conductive materials include copper, brass, nickel, zinc, chromium, stainless steel, conductive plastics and rubbers, aluminum, semi-transparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein, or through conditioning in a humid atmosphere to ensure the presence of sufficient water content to render the material conductive, indium, tin, metal oxides, including tin oxide and indium tin oxide, and the like.

In some cases, an anti-curl back coating may be applied to the side opposite the photoreceptor to provide flatness and/or abrasion resistance where a web configuration photoreceptor is fabricated. Anti-curl back coating layers are well known in the art and may include thermoplastic organic polymers or inorganic polymers that are electrically insulating or slightly semi-conductive. The thickness of anti-curl backing layers should be sufficient to substantially balance the total forces of the layer or layers on the opposite side of the supporting substrate layer. An example of an anti-curl backing layer is described in U.S. Pat. No. 4,654,284, the entire disclosure of which is incorporated herein by reference. A thickness between about 70 and about 160 micrometers is a satisfactory range for flexible photoreceptors.

After formation of an electrically conductive surface, a hole blocking layer may optionally be applied to the substrate layer. Generally, hole blocking layers (also referred to as electron blocking layers or charge blocking layers) allow holes from the imaging surface of the photoreceptor to migrate toward the conductive layer. Any suitable blocking layer capable of forming an electronic barrier to holes between the adjacent photoconductive layer and the underlying conductive layer may be utilized. Blocking layers are well known and disclosed, for example, in U.S. Pat. Nos. 4,286,033, 4,291,110 and 4,338,387, the entire disclosures of each of which are incorporated herein by reference. Similarly, illustrated in U.S. Pat. Nos. 6,255,027, 6,177,219, and 6,156,468, the entire disclosures of each of which are incorporated herein by reference, are, for example, photoreceptors containing a hole blocking layer of a plurality of light scattering particles dispersed in a binder. For instance, Example 1 of U.S. Pat. No. 6,156,468 discloses a hole blocking layer of titanium dioxide dispersed in a linear phenolic binder.

Hole blocking layers utilized for the negatively charged photoconductors may include, for example, polyamides including LUCKAMIDE® (a nylon type material derived from methoxymethyl-substituted polyamide commercially available from Dai Nippon Ink), hydroxy alkyl methacrylates, nylons, gelatin, hydroxyl alkyl cellulose, organopolyphosphazines, organosilanes, organotitanates, organozirconates, metal oxides of titanium chromium, zinc, tin, silicon, and the like. In some embodiments the hole blocking layer may include nitrogen containing siloxanes. Nitrogen containing siloxanes may be prepared from coating solutions containing a hydrolyzed silane. Hydrolyzable silanes include 3-aminopropyl triethoxy silane, N,N'-dimethyl 3-amino)propyl triethoxysilane, N,N-dimethylamino phenyl triethoxy silane, N-phenyl aminopropyl trimethoxy silane, trimethoxy silylpropyldiethylene triamine and mixtures thereof.

In some embodiments, the hole blocking components may be combined with phenolic compounds, a phenolic resin, or a mixture of 2 phenolic resins. Suitable phenolic compounds which may be utilized may contain at least two phenol groups, such as bisphenol A (4,4'-isopropylidenediphenol), bisphenol E (4,4'-ethylidenebisphenol), bisphenol F (bis(4-hydroxyphenyl)methane), bisphenol M (4,4'-(1,3-phenylenediisopropylidene)bisphenol), bisphenol P (4,4'-(1,4-phenylene diisopropylidene)bisphenol), bisphenol S (4,4'-sulfonyldiphenol), and bisphenol Z (4,4'-cyclohexylidenebisphenol), hexafluorobisphenol A (4,4'-(hexafluoro isopropylidene)diphenol), resorcinol, hydroxyquinone, catechin, and the like.

The hole blocking layer may be applied as a coating by any suitable conventional technique such as spraying, die coating, dip coating, draw bar coating, gravure coating, silk screening, air knife coating, reverse roll coating, vacuum deposition, chemical treatment and the like. For convenience in obtaining thin layers, the blocking layers may be applied in the form of a dilute solution, with the solvent being removed after deposition of the coating by conventional techniques such as by vacuum, heating and the like. Drying of the deposited coating may be effected by any suitable conventional technique such as oven drying, infrared radiation drying, air drying and the like.

The blocking layer may include an oxidized surface which forms on the outer surface of most metal ground plane surfaces when exposed to air. The blocking layer should be continuous and have a thickness of from about 0.01 micrometers to about 30 micrometers, in embodiments from about 0.1 micrometers to about 8 micrometers.

An optional adhesive layer may be applied to the hole blocking layer. Any suitable adhesive layer known in the art may be utilized including, but not limited to, polyesters, polyamides, poly(vinyl butyral), poly(vinyl alcohol), polyurethane and polyacrylonitrile. Where present, the adhesive layer may be, for example, of a thickness of from about 0.001 micrometers to about 1 micrometer. Satisfactory results may be achieved with an adhesive layer thickness between about 0.05 micrometers (500 Angstroms) and about 0.3 micrometers (3,000 Angstroms). Optionally, the adhesive layer may contain effective suitable amounts, for example from about 1 weight percent to about 10 weight percent, of conductive and nonconductive particles, such as zinc oxide, titanium dioxide, silicon nitride, carbon black, and the like, to provide further desirable electrical and optical properties to the photoreceptor of the present disclosure. Conventional techniques for applying an adhesive layer coating mixture to the hole blocking layer include spraying, dip coating, roll coating, wire wound rod coating, gravure coating, die coating and the like. Drying of the deposited coating may be effected by any suitable conventional technique such as oven drying, infrared radiation drying, air drying and the like.

In embodiments, a charge generating layer may be applied to the substrate, optional hole blocking layer, or optional adhesive layer. The charge generating layer can contain known photogenerating components, i.e., pigments, such as metal phthalocyanines, metal free phthalocyanines, alkylhydroxyl gallium phthalocyanine, hydroxygallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium.

The photogenerating component can be dispersed in a resin binder, or alternatively no resin binder can be present. Any suitable film forming polymer or combination of film forming polymers can be utilized as the binder resin to form the dispersion utilized to form the charge generation layer. Examples of suitable binder resins for use in preparing the dispersion include thermoplastic and thermosetting resins such as polycarbonates, polyesters including poly(ethylene terephthalate), polyurethanes including poly(tetramethylene hexamethylene diurethane), polystyrenes including poly (styrene-co-maleic anhydride), polybutadienes including polybutadiene-graft-poly(methyl acrylate-co-acrylontrile), polysulfones including poly(1,4-cyclohexane sulfone), polyarylethers including poly(phenylene oxide), polyarylsulfones including poly(phenylene sulfone), polyethersulfones including poly(phenylene oxide-co-phenylene sulfone), polyethylenes including poly(ethylene-co-acrylic acid), polypropylenes, polymethylpentenes, polyphenylene sulfides, polyvinyl acetates, polyvinylbutyrals, polysiloxanes including poly(dimethylsiloxane), polyacrylates including poly(ethyl acrylate), polyvinyl acetals, polyamides including poly(hexamethylene adipamide), polyimides including poly(pyromellitimide), amino resins including poly(vinyl amine), phenylene oxide resins including poly(2,6-dimethyl-1,4-phenylene oxide), terephthalic acid resins, phenoxy resins including poly(hydroxyethers), epoxy resins including poly([(o-cresyl glycidyl ether)-co-formaldehyde], phenolic resins including poly(4-tert-butylphenol-co-formaldehyde), polystyrene and acrylonitrile copolymers, polyvinylchlorides, polyvinyl alcohols, poly-N-vinylpyrrolidinones, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like, and combinations thereof. These polymers may be block, random, or alternating copolymers.

Examples of suitable polycarbonates which may be utilized to form the dispersion utilized to form the charge generation layer include, but are not limited to, poly(4,4'-isopropylidene diphenyl carbonate) (also referred to as bisphenol A polycarbonate), poly(4,4'-diphenyl-1,1'-cyclohexane carbonate) (also referred to as bisphenol Z polycarbonate, polycarbonate Z, or PCZ), poly(4,4'-sulfonyl diphenyl carbonate) (also referred to as bisphenol S polycarbonate), poly(4,4'-ethylidene diphenyl carbonate) (also referred to as bisphenol E polycarbonate), poly(4,4'-methylidene diphenyl carbonate) (also referred to as bisphenol F polycarbonate), poly(4,4'-(1,3-phenylenediisopropylidene)diphenyl carbonate) (also referred to as bisphenol M polycarbonate), poly(4,4'-(1,4-phenylenediisopropylidene) diphenyl carbonate) (also referred to as bisphenol P polycarbonate), and poly(4,4'-hexafluoroisppropylidene diphenyl carbonate).

Examples of suitable vinyl chloride and vinyl acetate copolymers which may be utilized to form the dispersion utilized to form the charge generation layer include, but are not limited to, carboxyl-modified vinyl chloride/vinyl acetate copolymers such as VMCH (available from Dow Chemical) and hydroxyl-modified vinyl chloride/vinyl acetate copolymers such as VAGF (available from Dow Chemical).

The molecular weight of the binder resin used to form the charge generation layer may be from about 1000 to about 10000, in embodiments from 3000 to about 9000.

The charge generating layer containing photoconductive compositions and the resinous binder material generally is of a thickness from about 0.05 micrometers to about 100 micrometers, in embodiments from about 0.1 micrometers to about 5 micrometers, in embodiments from about 0.3 micrometers to about 3 micrometers.

When the photogenerating material is present in a binder material, the photogenerating component or pigment may be present in a polymer binder composition in any suitable or desired amounts. The photogenerating material may be present in the charge generating layer in an amount of from about 5 percent to about 80 percent by weight of the charge generating layer and, in embodiments, from about 25 percent to about 75 percent by weight of the charge generating layer. Thus, the polymeric binder may be present in an amount from about 20 percent to about 95 percent by weight of the charge generating layer and, in embodiments, from about 25 percent to about 75 percent by weight of the charge generating layer.

As would be readily appreciated by one skilled in the art, the charge generating layer thickness is related to the relative amounts of photogenerating compound and binder; higher binder content compositions generally require thicker layers for photogeneration. Generally, it may be desirable to provide this layer in a thickness sufficient to absorb about 90 percent of the incident radiation which is directed upon it in the imagewise or printing exposure step. The maximum thickness of this layer depends upon factors such as mechanical considerations, the specific photogenerating compound selected, the thicknesses of the other layers, and whether a flexible photoconductive imaging member is desired. The charge generation layer can be of a thickness of, for example, from about 0.05 micrometers to about 10 micrometers, in embodiments from about 0.25 micrometers to about 2 micrometers.

Any suitable technique may be utilized to mix and thereafter apply the charge generating layer coating mixture to an underlying layer of a photoreceptor, such as a substrate. Application techniques include spraying, dip coating, roll coating, wire wound rod coating, and the like. Drying of the deposited coating may be effected by any suitable technique, such as, oven drying, infrared radiation drying, air drying, and the like.

In some embodiments a solvent may be utilized to apply the charge generation layer to the photoreceptor. Any coating solvent utilized should not substantially disturb or adversely affect the other previously coated layers of the device. Examples of solvents that can be selected for use as coating solvents for the charge generating layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

In embodiments the photoreceptor includes a charge transport layer applied over the charge generation layer. The charge transport layer in embodiments includes a charge transport or hole transport molecule (HTM) dispersed in an inactive polymeric material. These compounds may be added to polymeric materials which are otherwise incapable of supporting the injection of photogenerated holes from the charge generation layer and incapable of allowing the transport of these holes therethrough. The addition of these HTMs converts the electrically inactive polymeric material to a material capable of supporting the direction of photogenerated holes from the charge generation layer and capable of allowing the transport of these holes through the charge transport layer in order to discharge the surface charge on the charge transport layer.

Suitable polymers for use in forming the charge transport layer are film forming binder resins known to those skilled in the art. Examples include those polymers utilized to form the charge generation layer. In embodiments resin materials for use in forming the charge transport layer are electrically inactive resins including polycarbonate resins having a weight average molecular weight from about 20,000 to about 150,000, in embodiments from about 50,000 to about 120,000. Electrically inactive resin materials which may be utilized in the charge transport layer include poly(4,4'-dipropylidene-diphenylene carbonate) with a weight average molecular weight of from about 35,000 to about 40,000, available as LEXAN® 145 from General Electric Company; poly(4,4'-propylidene-diphenylene carbonate) with a weight average molecular weight of from about 40,000 to about 45,000, available as LEXAN® 141 from the General Electric Company; a polycarbonate resin having a weight average molecular weight of from about 50,000 to about 100,000, available as MAKROLON® from Farbenfabricken Bayer A.G.; and a polycarbonate resin having a weight average molecular weight of from about 20,000 to about 50,000 available as MERLON® from Mobay Chemical Company. Methylene chloride solvent may be utilized in forming the charge transport layer coating mixture.

Any suitable charge transporting or electrically active molecules known to those skilled in the art may be employed as HTMs in forming a charge transport layer on a photoreceptor. Suitable charge transporting molecules include, for example, aryl amines as disclosed in U.S. Pat. No. 4,265,990, the entire disclosure of which is incorporated by reference herein. In some embodiments, an aryl amine charge hole transporting component may be represented by:

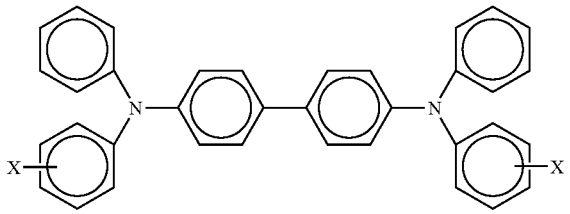

wherein X is selected from the group consisting of alkyl, halogen, alkoxy or mixtures thereof. In embodiments, the halogen is a chloride. Alkyl groups may contain from about 1 to about 10 carbon atoms and, in embodiments, from about 1 to about 5 carbon atoms. Examples of suitable aryl amines include, but are not limited to, N,N'-diphenyl-N,N'-bis(alkylphenyl)-1,1-biphenyl-4,4'-diamine, wherein the alkyl may be methyl, ethyl, propyl, butyl, hexyl, and the like; and N,N'-diphenyl-N,N'-bis(halophenyl)-1,1'-biphenyl-4,4'-diamine, wherein the halo may be a chloro, bromo, fluoro, and the like substituent.

Other suitable aryl amines which may be utilized as an HTM in a charge transport layer include, but are not limited to, tritolylamine, N,N'-bis(3,4 dimethylphenyl)-N"(1-biphenyl)amine, 2-bis((4'-methylphenyl)amino-p-phenyl) 1,1-diphenyl ethylene, 1 -bisphenyl-diphenylamino-1-propene, triphenylmethane, bis(4-diethylamine-2-methylphenyl)phenylmethane, 4'-4"-bis(diethylamino)-2',2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(3"-methylphenyl)-(1,1'-biphenyl)-4,4'-diamine, and the like.

The weight ratio of the polymer binder to charge transport molecules in the resulting charge transport layer can vary, for example, from about 80/20 to about 30/70, in embodiments from about 75/25 to about 50/50.

Any suitable and conventional technique may be utilized to mix the polymer binder in combination with the hole transport material and apply same as a charge transport layer to a photoreceptor. In embodiments, it may be advantageous to add the polymer binder and hole transport material to a solvent to aid in formation of a charge transport layer and its application to a photoreceptor. Examples of solvents which may be utilized include aromatic hydrocarbons, aliphatic hydrocarbons, halogenated hydrocarbons, ethers, amides and the like, or mixtures thereof. In some embodiments, a solvent such as cyclohexanone, cyclohexane, chlorobenzene, carbon tetrachloride, chloroform, methylene chloride, trichloroethylene, tetrahydrofuran, dioxane, dimethyl formamide, dimethyl acetamide and the like, may be utilized in various amounts, such as from about 50 milliliters to about 1,000 milliliters. Application techniques of the charge transport layer include spraying, dip coating, roll coating, wire wound rod coating, and the like. Drying of the deposited coating may be effected by any suitable conventional technique such as oven drying, infrared radiation drying, air drying and the like.

Generally, the thickness of the charge transport layer can vary from about 2 micrometers to about 50 micrometers. The charge transport layer should be an insulator to the extent that the electrostatic charge placed on the charge transport layer is not conducted in the absence of illumination at a rate sufficient to prevent formation and retention of an electrostatic latent image thereon.

Where present in a photoreceptor, the charge generating layer, charge transport layer, and other layers may be applied in any suitable order to produce either positive or negative charging photoreceptors. For example, the charge generating layer may be applied prior to the charge transport layer, as illustrated in U.S. Pat. No. 4,265,990, or the charge transport layer may be applied prior to the charge generating layer, as illustrated in U.S. Pat. No. 4,346,158, the entire disclosures of each of which are incorporated by reference herein. In other embodiments, the charge transport layer may optionally be overcoated with an overcoat and/or protective layer.

Processes of imaging, especially xerographic imaging and printing, including digital, are also encompassed by the present disclosure. More specifically, the layered photoconductive imaging members of the present disclosure can be selected for a number of different known imaging and printing processes including, for example, electrophotographic imaging processes, especially xerographic imaging and printing processes wherein charged latent images are rendered visible with toner compositions of an appropriate charge polarity. Methods of imaging and printing with the photoresponsive devices illustrated herein generally involve the formation of an electrostatic latent image on the imaging member, followed by developing the image with a toner composition. The toner composition can include, for example, thermoplastic resin, colorant, such as photogenerating component, charge additive, and surface additives. (See, e.g., U.S. Pat. Nos. 4,560,635; 4,298,697 and 4,338,390, the disclosures of each of which are incorporated herein by reference.) The image is then transferred to a suitable substrate and permanently affixed thereto. In those environments wherein the device is to be used in a printing mode, the imaging method involves the same aforementioned sequence with the exception that the exposure step can be accomplished with a laser device or image bar.

The imaging members may be sensitive in the wavelength region of, for example, from about 500 to about 900 nanometers, in embodiments from about 650 to about 850 nanometers; thus diode lasers can be selected as the light source. Moreover, the imaging members of this disclosure may be useful in color xerographic applications, particularly high-speed color copying and printing processes.

The method of texturing the external surface of a photoreceptor herein reduces lateral charge migration defects, thereby extending the useful life of the photoreceptor. The lateral charge migration life of a textured photoreceptor of the present disclosure is at least 6 times greater than the life of an untreated photoreceptor, due to the breaking up of the lateral conductivity pathways along the surface of the textured photoreceptor.

Without wishing to be bound by any theory, one possible explanation for the effectiveness of texturing to reduce lateral charge migration may be the blocking effect of the pits formed on the external surface of the textured photoreceptor. Because of the depth of the pits, they are not as easily coated with an additive film as the flat areas of the photoreceptor. Lacking a film, the pits are less prone to lateral migration of charge. Thus, any charge migrating across a flat area of the textured photoreceptor of the present disclosure is likely to encounter a pit edge because of the high density of the pits. Once the charge arrives at the pit edge, it is trapped there and is incapable of further lateral migration.

A second possible explanation for the avoidance of lateral charge migration on a textured photoreceptor of the present disclosure involves the uplifted pit edges where the conductive salts and film are more easily abraded during the cleaning process with the blade or a cleaning brush. Laterally migrating charge arriving at the pit edges does not migrate further, so the cleaned pit edges can also block the lateral migration of charge. Without the pits on the external surface of the textured photoreceptor, the surface salts would remain and a continuous film would be formed.

Texturing of the photoreceptor surface also reduces the contact area of the photoreceptor to the spots blade, lowering the dynamic friction of the blade with the photoreceptor. Improvement of the cleaning function of the blade may also be expected, as the textured surface provides a perch for the toner and additive particles, which reduces the contact area. As the additive particles are raised, their mechanical adhesion to the photoreceptor is reduced, thereby enabling improved cleaning. The textured surface of the photoreceptor also reduces conductive film/salt and toner additive build up as well as fuser oil contamination. Additional improvements may include improved toner transfer efficiency, as the adhesion forces on the particles are reduced due to smaller contact areas. Moreover, reduced developer bead attachment and bead scratching may result with the textured photoreceptors of the present disclosure.

The following Examples are being submitted to illustrate embodiments of the present disclosure. These Examples are intended to be illustrative only and are not intended to limit the scope of the present disclosure.

EXAMPLE 1

Part of the surface of an iGEN3® color printer (from Xerox Corporation, Stamford, Conn.) belt photoreceptor was textured by blasting the surface with sodium bicarbonate (baking soda) at 100 psi using a siphon fed sand blaster for 1 minute. The resulting textured portion of the photoreceptor had a matte appearance and was roughened. The untreated portion of the photoreceptor was utilized as a control. The photoreceptor was placed in an iGEN-3® color printer and prints were made. Surface profiles of the photoreceptor indicated the extent of photoreceptor roughening and were obtained with a TSK Surfcom 570A Surface Texture Measurement System (from Tokyo Seimitsu Co. Ltd., Japan), the results of which are set forth in FIG. 1. The textured area had a roughness Ra=0.51 μm compared to the control area roughness Ra=0.07 μm as shown in the scans depicted in FIG. 1. The blasting process created a surface consisting of pockets or pits and plateaus. As can be seen in FIG. 1, there was a large positive departure of the profile of the textured surface from centerline, probably as a result of uplifting at pit edges.

Figure 2:
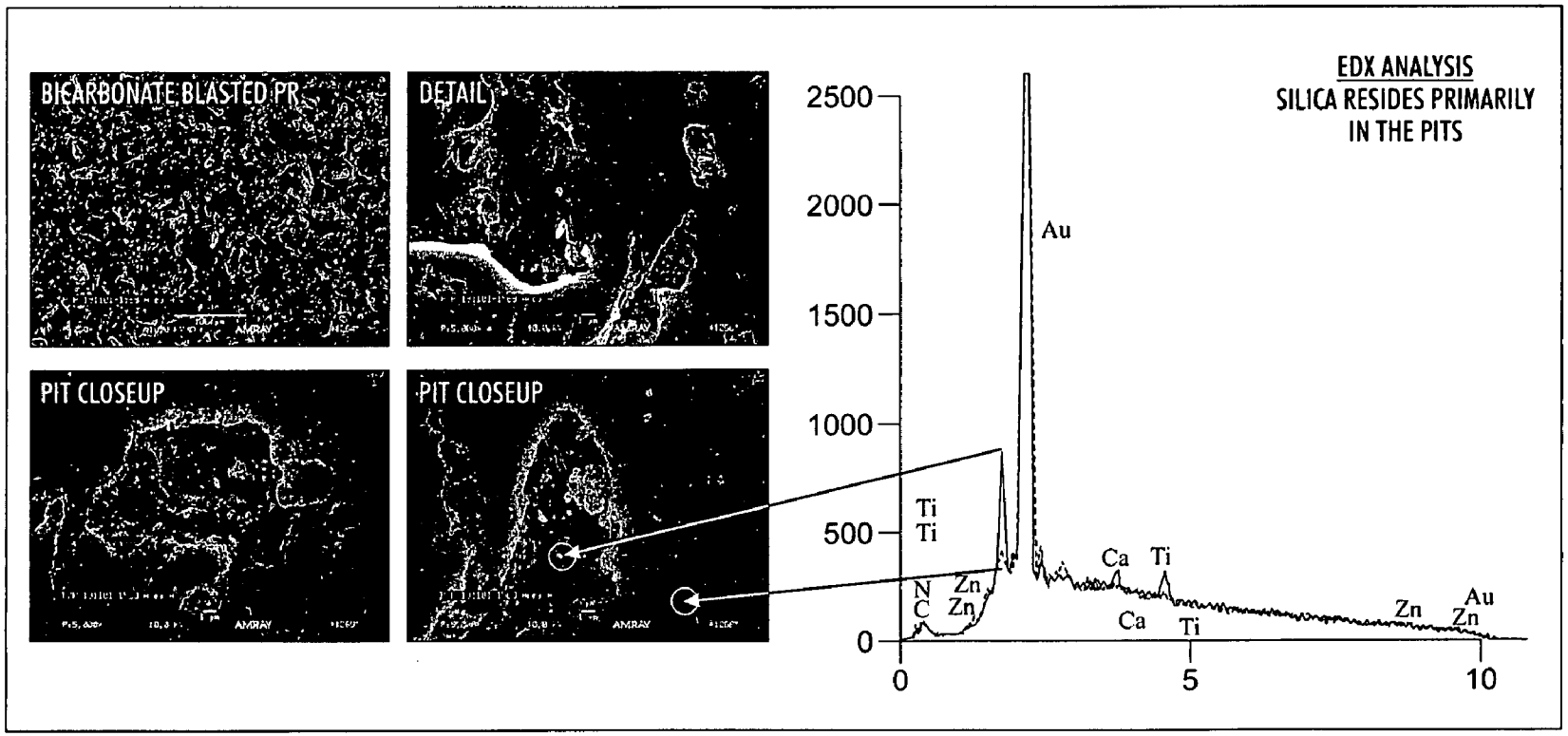
FIG. 2 are scanning electron micrographs and energy dispersive x-ray spectrographs of textured photoreceptor surfaces prepared in accordance with the present disclosure.

Scanning electron micrographs of the surfaces were obtained utilizing an Amray 3300 field-emission SEM at an accelerating voltage of 10 kV and are depicted in FIG. 2. These micrographs show that the surface texture was non-directional and resulted from numerous pits of varying size, shape and depth surrounded by relatively flat areas. Energy dispersive x-ray spectroscopy was also conducted on the surfaces. The results in FIG. 2 show that loose material like $SiO_2$ and $TiO_2$ toner additives and $CaCO_3$ paper debris accumulated primarily in the pits while the flat areas of the photoreceptor were fairly free of additives and debris. Zinc stearate, which contributes to lateral charge migration, was found mainly in the plateaus.

EXAMPLE 2

The lateral charge migration performance of the textured belt photoreceptor produced in Example 1 was tested. An accelerated lateral charge migration test was developed based on introduction into the xerographic cavity of morpholine, a volatile amine associated with humidification in air handling systems. Morpholine was used because the threshold concentration for lateral charge migration onset with morpholine is only 2-3 ppb morpholine. Utilizing this test, 75±10 ppb morpholine vapor (as measured by Tenax tube sampling) was introduced into the xerographic cavity. The xerographic cavity was bathed in morpholine vapor for 20 minutes before start of printing to ensure a steady state concentration throughout the cavity. A stress test document was utilized to make prints; the stress document included toned and background areas for each color. This was run for 90 prints followed by 10 magenta zip tone documents of 4 pixels on/4 pixels off. The latter document was especially sensitive to the LCM defect. The set of 100 stress and analytical documents was repeated until evidence of LCM was observed.

Figure 3:
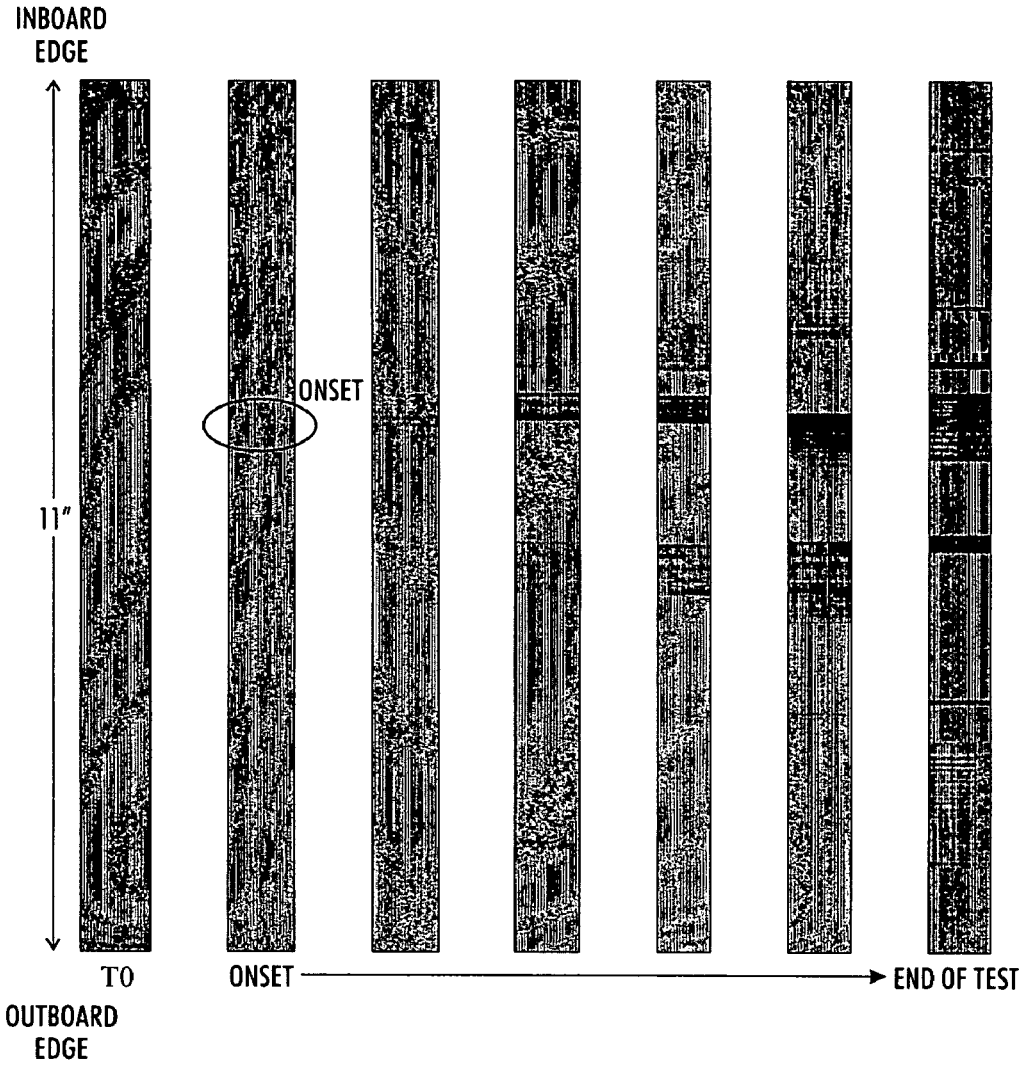
FIG. 3 is a series of images obtained from a document scanner of prints made with a control photoreceptor, demonstrating the LCM development of an untreated photoreceptor.

Lateral charge migration was manifested by broadening of individual lines in the 4-on/4-off target. FIG. 3 are magnified images obtained from an Epson 1260 document scanner of sections of prints made with an untextured iGEN3® photoreceptor as a control demonstrating the normal course of LCM development of an untreated photoreceptor. The LCM signature started at a position about ⅔ of the way inboard seemingly due to charger airflow interaction with the photoreceptor and other airflow patterns in the machine. LCM first manifested itself as a narrow line in the process direction resulting from the broadening of the zip tones. This is illustrated in the second panel from the left in attached FIG. 3. LCM onset for control photoreceptors under these conditions was between 1000 and 1200 prints in these accelerated tests.

FIG. 3 further illustrates the progression with time of the LCM problem. As LCM became more severe, it spread both inboard and outboard from the initial position covering a larger and larger fraction of the page. A semi-quantitative measure of LCM severity is the width of the page covered by the defect.

Figure 4:
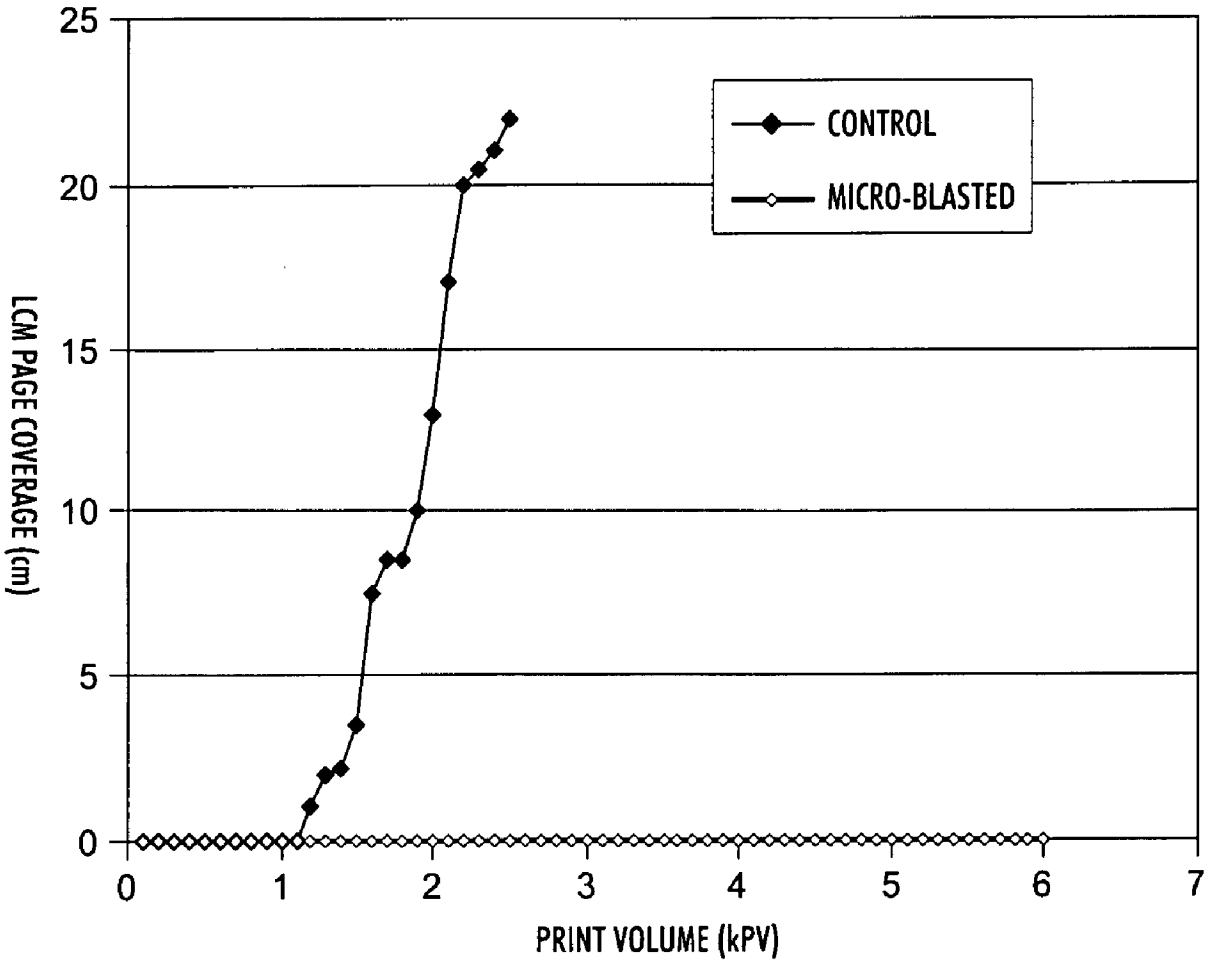
FIG. 4 is a graph depicting the increase in LCM severity over time for both control and textured photoreceptors of the present disclosure.
Figure 5:
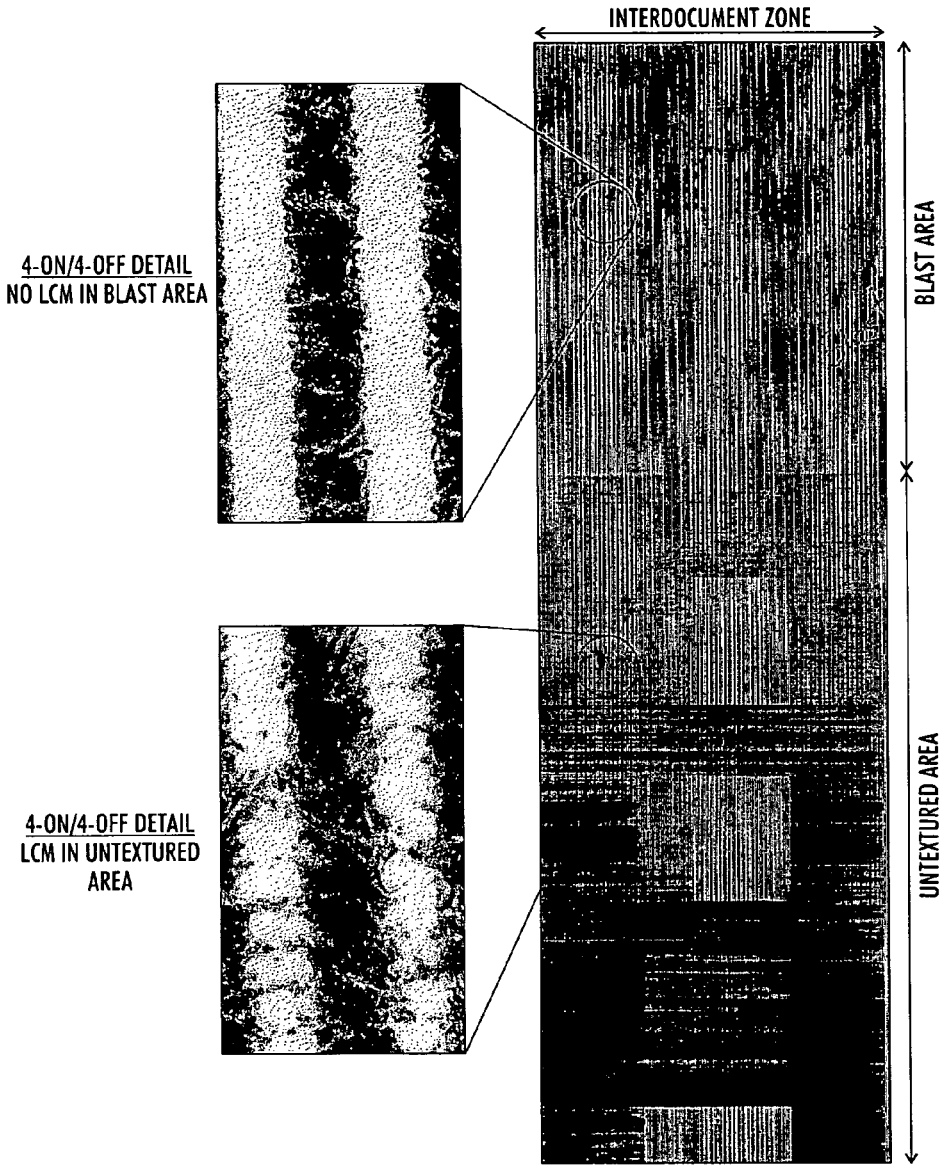
FIG. 5 are images obtained from a document scanner of prints made with the textured photoreceptors of the present disclosure, which show a major improvement in LCM performance in the interdocument zone (IDZ) for textured photoreceptors compared to control photoreceptors.

Attached FIG. 4 plots the increase in LCM severity over time with both control and textured photoreceptors. While LCM onset for the control belt was about 1,100 pages and the LCM severity increased rapidly with print volume, the textured area of the photoreceptor in the blasted area of the image panel showed no LCM image quality defect at 6,000 pages when the test was stopped. FIG. 5 presents close-up images obtained with an Epson 1260 document scanner of 4 pixel wide line images made with the textured photoreceptors of the present disclosure. The latter shows a major improvement in LCM performance in the interdocument zone (IDZ) for textured photoreceptors compared to control. As shown in FIG. 5, LCM was quite severe at 6,000 pages in the untextured areas of the IDZ. However, LCM was absent from the blasted area in the IDZ demonstrating the effectiveness of photoreceptor surface texturing against LCM.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A method comprising subjecting the external surface of a photoreceptor to an abrasive component by blasting the external surface of the photoreceptor with the abrasive component at a pressure of from about 5 psi to about 150 psi to produce a textured photoreceptor.

2. The method of claim 1 wherein the abrasive component is selected from the group consisting of bicarbonate salts, carbonate salts, polymers, minerals, and combinations thereof.

3. The method of claim 1 wherein the abrasive component is selected from the group consisting of sodium bicarbonate, sodium carbonate, water, ice, glass particles, steel particles, polyesters, urea-formaldehyde, melamine-formaldehyde, phenol-formaldehyde, acrylics, starch-acrylics, kieserite, garnet, aluminum oxide, silicon carbide, silicon oxide, pumice, ground walnuts, walnut shell flour, ground peanut shells, wheat starch, corn cob, rice hulls and combinations thereof.

4. The method of claim 1 wherein the abrasive component comprises carbon dioxide.

5. The method of claim 1 wherein the abrasive component has a particle size from about 0.5 micrometers in diameter to about 1000 micrometers in diameter.

6. The method of claim 1 wherein the abrasive component has a particle size from about 40 micrometers in diameter to about 300 micrometers in diameter.

7. The method of claim 1 wherein the textured photoreceptor has a mean surface roughness from about 0.1 micrometers to about 1.0 micrometers.

8. The method of claim 1 wherein the textured photoreceptor has a mean surface roughness from about 0.15 micrometers to about 0.5 micrometers.

9. A method for reducing lateral charge migration defects in a photoreceptor comprising subjecting the external surface of the photoreceptor to an abrasive component by blasting the external surface of the photoreceptor with the abrasive component at a pressure of from about 5 psi to about 150 psi to produce a textured photoreceptor.

10. The method of claim 9 wherein the abrasive component is selected from the group consisting of bicarbonate salts, carbonate salts, polymers, minerals, and combinations thereof.

11. The method of claim 9 wherein the abrasive component is selected from the group consisting of sodium bicarbonate, sodium carbonate, water, ice, dry ice, carbon dioxide pellets, glass particles, steel particles, polyesters, urea-formaldehyde, melamine-fonnaldehyde, phenol-formaldehyde, acrylics, starch-acrylics, kieserite, garnet, aluminum oxide, silicon carbide, silicon oxide, pumice, ground walnuts, walnut shell flour, ground peanut shells, wheat starch, corn cob, rice hulls and combinations thereof.

12. The method of claim 9 wherein the abrasive component has a particle size from about 0.5 micrometers in diameter to about 1000 micrometers in diameter.

13. The method of claim 9 wherein the abrasive component has a particle size from about 40 micrometers in diameter to about 300 micrometers in diameter.

14. The method of claim 9 wherein the textured photoreceptor has a mean surface roughness from about 0.1 micrometers to about 1.0 micrometers.

15. The method of claim 9 wherein the textured photoreceptor has a mean surface roughness from about 0.15 micrometers to about 0.5 micrometers.

16. A photoreceptor comprising a charge generation layer and a charge transport layer, wherein a surface of the charge generation layer is textured by subjecting said surface to an abrasive component selected from the group consisting of sodium bicarbonate, sodium carbonate, water, ice, dry ice, carbon dioxide pellets, glass particles, steel particles, polyesters, urea-formaldehyde, melamine-formaldehyde, phenol-formaldehyde, acrylics, starch-acrylics, kieserite, garnet, aluminum oxide, silicon carbide, silicon oxide, pumice, ground walnuts, walnut shell flour, ground peanut shells, wheat starch, corn cob, rice hulls and combinations thereof, and wherein the textured surface possesses a mean surface roughness of from about 0.1 micrometers to about 1 micrometers.

17. The photoreceptor of claim 16, wherein the surface has a mean surface roughness from about 0.15 micrometers to about 0.5 micrometers.

18. The photoreceptor of claim 16, wherein the life of the photoreceptor is at least about 6 times greater than the life of an untreated photoreceptor.

19. The photoreceptor of claim 16 wherein the charge generation layer comprises a resin and a photogenerating component selected from the group consisting of metal phthalocyanines, metal free phthalocyanines, alkylhydroxyl gallium phthalocyanines, hydroxygallium phthalocyanines, perylenes, selenium, selenium alloys, and trigonal selenium, and the charge transport layer comprises a resin and an aryl amine hole transport molecule.

20. A method comprising blasting the external surface of a photoreceptor with an abrasive component at a pressure of from about 5 psi to about 150 psi for an optional period of time of from about 0.1 seconds to about 10 minutes.

21. The method of claim 20 wherein the external surface of the photoreceptor is blasted with an abrasive component at a pressure of from about 50 psi to about 125 psi for a period of time ranging from about 30 seconds to about 3 minutes.

* * * * *